US006964297B1

(12) United States Patent
Janezich et al.

(10) Patent No.: US 6,964,297 B1
(45) Date of Patent: Nov. 15, 2005

(54) REMOVABLE TUBE HEAT EXCHANGER AND HEADER PLATE

(75) Inventors: Robert Janezich, Hibbing, MN (US); James Comstock, Goodland, MN (US); Todd G. Dosen, Side Lake, MN (US)

(73) Assignee: L & M Radiator, Inc., Hibbing, MN (US)

( * ) Notice: Subject to any disclaimer, the term of this patent is extended or adjusted under 35 U.S.C. 154(b) by 0 days.

(21) Appl. No.: 09/357,356

(22) Filed: Jul. 14, 1999

Related U.S. Application Data

(60) Provisional application No. 60/092,826, filed on Jul. 14, 1998.

(51) Int. Cl.[7] ..... F28F 9/04

(52) U.S. Cl. ..... 165/178; 165/76; 165/173; 285/19; 285/231

(58) Field of Search ..... 165/178, 175, 165/173, 76; 285/19, 20, 31, 141.1, 231, 285/245

(56) References Cited

U.S. PATENT DOCUMENTS

| | | | | |
|---|---|---|---|---|
| 911,156 A | * | 2/1909 | Politz | 165/173 X |
| 2,468,924 A | | 5/1949 | Courtier | |
| 3,391,732 A | | 7/1968 | Murray | |
| 3,494,414 A | | 2/1970 | Warner | |
| 3,741,570 A | * | 6/1973 | Garrett | 285/231 X |
| 3,787,945 A | * | 1/1974 | Pasek et al. | 165/175 X |
| 3,923,314 A | * | 12/1975 | Lawler et al. | 165/178 X |
| 4,026,456 A | | 5/1977 | Lema | |
| 4,216,824 A | | 8/1980 | Braun et al. | |
| 4,344,478 A | | 8/1982 | Petaja et al. | 165/76 X |
| 4,421,160 A | | 12/1983 | Stafford et al. | |
| 4,547,943 A | | 10/1985 | Hoeffken | |
| 4,570,704 A | | 2/1986 | Braun et al. | |
| 4,651,821 A | | 3/1987 | Moranne | |
| 4,773,475 A | | 9/1988 | Sleep, Jr. | |
| 4,930,568 A | | 6/1990 | Janezich et al. | |
| 4,993,485 A | | 2/1991 | Gorman | |
| 5,027,495 A | | 7/1991 | Usui et al. | |
| 5,236,045 A | | 8/1993 | Janezich et al. | |
| 5,324,084 A | * | 6/1994 | Bodas et al. | 165/173 X |
| 5,433,268 A | | 7/1995 | Janezich et al. | |
| 5,467,818 A | | 11/1995 | Buckley, Jr. | |

FOREIGN PATENT DOCUMENTS

| | | | | |
|---|---|---|---|---|
| BE | 515235 | * | 11/1952 | 165/178 |
| EP | 0 481 178 | | 4/1992 | |
| FR | 418770 | * | 12/1910 | 165/178 |
| GB | 315934 A | * | 7/1929 | 165/76 |
| GB | 2136945 | * | 9/1984 | 165/178 |
| IT | 312065 | * | 3/1937 | 285/19 |
| SU | 1370422 | * | 1/1988 | 165/173 |
| WO | 04333 | * | 3/1993 | 165/173 |

* cited by examiner

*Primary Examiner*—Leonard R. Leo
(74) *Attorney, Agent, or Firm*—Banner & Witcoff, Ltd.

(57) ABSTRACT

A heat exchanger design is described which includes header plates, apertures, seals and flow tubes. A plurality of apertures in at least one header plate are configured to allow a flow tube to be inserted into or removed from the aperture as a whole at an angle. A seal is included within the aperture and is supported by differing diameters of the aperture wall. The seal engages the flow tube in a manner to allow high pressure operation of the heat exchanger when the flow tube is perpendicular to the header plate.

14 Claims, 5 Drawing Sheets

POSSIBLE
PRESSURE SEAL
CROSS SECTIONS

POSSIBLE
DUST SEAL
CROSS SECTIONS

REMOVABLE TUBE HEAT EXCHANGER AND HEADER PLATE

This application claims the benefit of the filing date of provisional application Ser. No. 60/092,826 filed Jul. 14, 1998 hereby incorporated by reference in its entirety for all purposes.

INTRODUCTION

The present invention is directed to a removable tube heat exchanger and header plate, and, more particularly, to an improved heat exchanger header plate for removable tube heat exchangers.

BACKGROUND

Heat exchangers typically are formed of a plurality of tube and fin assemblies, the ends of which extend through apertures in opposed header plates. A heating or cooling fluid, e.g., oil, air, etc. flows through the tubes. The tube and fin assemblies must be able to withstand system operating pressures without leaking. Elastomeric seals are sometimes used within the apertures in the header plates to seal the tube within the header plate thus forming a tube to header plate joint. Some heat exchanger designs allow the tube and fin assemblies to be removable such that a damaged tube can be replaced without dismantling an entire heat exchanger. According to prior art heat exchangers, the tubes are removed by raising a first end of a tube into the first of two header plates via a first aperture having a cylindrical seal along the entire length of the header plate opening until the second end of the tube clears the second of two header plates. The second end of the tube is swung outwardly to clear the edge of the second header plate and the tube, which is now angled relative to the first header plate, is then pulled from the first header plate, freeing it from the heat exchanger. Prior art aperture and seal designs allow an elastomeric seal to seat within the first header plate in order to seal the tube during heat exchanger operation, and also allow angular movement of a tube for removal and installation from the header plates. See, U.S. Pat. No. 3,391,732, U.S. Pat. No. 4,344,478, U.S. Pat. No. 4,216,824, U.S. Pat. Nos. 4,930,568, 5,433,268 each of which are hereby incorporated by reference in their entireties. However, prior art aperture and seal designs do not optimize the ability of the heat exchangers to withstand high operating pressures while also allowing easy removal and installation of individual heat exchanger tubes. Accordingly, it is an object of the present invention to provide an aperture and seal configuration to improve the ability of a heat exchanger to withstand high operating pressures while also allowing easy removal and installation of individual heat exchanger tubes. It is an additional object of the present invention to provide a heat exchanger header plate which reduces or wholly overcomes some or all of the difficulties inherent in prior known heat exchangers having field removable heat exchanger tubes such as pressure capabilities, seal integrity, and overall heat exchanger life expectancy. Particular objects and advantages of the invention will be apparent to those skilled in the art, that is, those who are knowledgeable or experienced in this field of technology, in view of the following disclosure of the invention and detailed description of certain preferred embodiments.

SUMMARY

Embodiments of the present invention may be used to advantageously provide a heat exchanger having advantageous pressure capabilities while facilitating the removal and installation of individual heat exchange tubes without disassembling the frame of the heat exchanger. The heat exchangers of the present invention include at least a top tank having a top header plate, a bottom tank having a bottom header plate, a frame work connecting the top and bottom tanks, apertures in the top and bottom header plates, seals and flow tubes configured to withstand system operating pressure. In accordance with one aspect of the present invention more fully described with reference to the Figures, the top header plate includes a plurality of apertures with each aperture having a nonuniform diameter of the interior aperture wall, for example, as determined at at least two, three or four locations from one end of the aperture to the other. The diameters of the aperture, and thus the wall of the aperture itself, are configured to allow a flow tube to be inserted into or removed from a heat exchanger frame via the aperture at an insertion angle. The insertion angle is defined as the angle at which the flow tube is inserted into or removed from the aperture and is determined in part by the length of the flow tube, the distance between top and bottom header plates and the direction of insertion of the flow tube into the aperture. The insertion angle must be sufficient to allow the flow tube to be inserted into the top header plate while avoiding contact with the bottom header plate. In this manner the flow tube can be inserted up into the aperture in the top header plate and then lowered into a corresponding aperture in the bottom header plate. The aperture, therefore, has a tolerance for the angled movement of a flow tube relative to its normal position when installed between header plates, i.e. the configuration of the wall of the aperture allows for the angled movement of the flow tube during removal or installation.

According to one embodiment, a seal is fixedly provided at a point within the aperture, such as the seal being retained within a groove within the wall of the aperture. According to an additional embodiment, differing diameters of the wall of the aperture provide shoulders which support the seal and retain the seal within the aperture upon installation and removal of the flow tube and also provide support for the seal during high or low pressure operation of the heat exchanger. According to one embodiment, the aperture has a groove within the interior wall of the aperture which fixedly retains the seal with the diameter of the aperture on either side of the seal being capable of allowing the angled insertion and removal of the flow tube. The flow tube protrudes at least into the header plate and engages the seal which is seated between the flow tube and the header plate. In a certain embodiment, the flow tube may also protrude beyond the header plate. As previously stated, the aperture has a diameter or other configuration sufficient to provide a tolerance to angled movement of the flow tube through the aperture. In this manner, the aperture may have one or more diameters greater than the diameter of the flow tube along a given axis. The seal also has a diameter or other configuration or dimension sufficient to engage the flow tube in a manner to allow high pressure operation of the heat exchanger when the flow tube is approximately perpendicular to the header plate yet allows angled movement of the flow tube through the aperture, i.e. the seal also has dimensions sufficient to allow it to be compressed to a certain design compression when the tube is fully inserted into the aperture and brought perpendicular to the header plates.

In accordance with an additional aspect of the present invention, a header plate for a heat exchanger has one or more circular apertures through the plate wherein each aperture has at least two differing diameters within the header plate. Alternatively, the aperture may have as many as three or four diameters represented by adjacent sections or portions with the diameter of each section or portion being the same as or different from another section or portion. The words "section' and "portion" are used interchangeably herein. According to one nonlimiting example, the header plate has an aperture with a first portion having a first diameter. The first portion is designed so that its diameter is sufficiently large to allow a flow tube to be inserted at an angle to the centerline of the aperture as a whole without interference detrimental to the condition of the flow tube or header plate. The first portion also provides support for one face of the seal. A second portion of the aperture having a second diameter is adjacent the first portion, with the second diameter being larger than the first diameter. The second portion retains the seal and allows the seal to be compressed to a design compression when the tube is fully inserted and brought to the approximate perpendicular. A third portion of the aperture having a third diameter is adjacent the second portion, with the third diameter being smaller than the second diameter. The third portion provides support for a second face of the seal and is also sufficiently large in diameter to allow the flow tube to be inserted at an angle to the centerline of the aperture as a whole without interference. A fourth portion having a fourth diameter is adjacent the third portion, with the fourth diameter being sufficiently large in diameter to allow the flow tube to be inserted at an angle to the centerline of the aperture as a whole without interference. Alternatively, the fourth portion can be of a conical design with a diameter gradually increasing toward the tank side of the header plate. According to one embodiment of the present invention, the diameters of the first, third, and fourth portions of the aperture progressively increase in diameter to allow the flow tube to be inserted at an angle to the centerline of the aperture as a whole.

From the foregoing disclosure, it will be readily apparent to those skilled in the art, that is, those who are knowledgeable or experienced in this area of technology, that the present invention provides a significant technological advance. Preferred embodiments of the heat exchanger header plate of the present invention can provide improved sealing and higher operating pressures while allowing heat exchanger tubes mounted therein to be individually removable, for example without dismantling the heat exchanger. These and additional features and advantages of the invention disclosed here will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
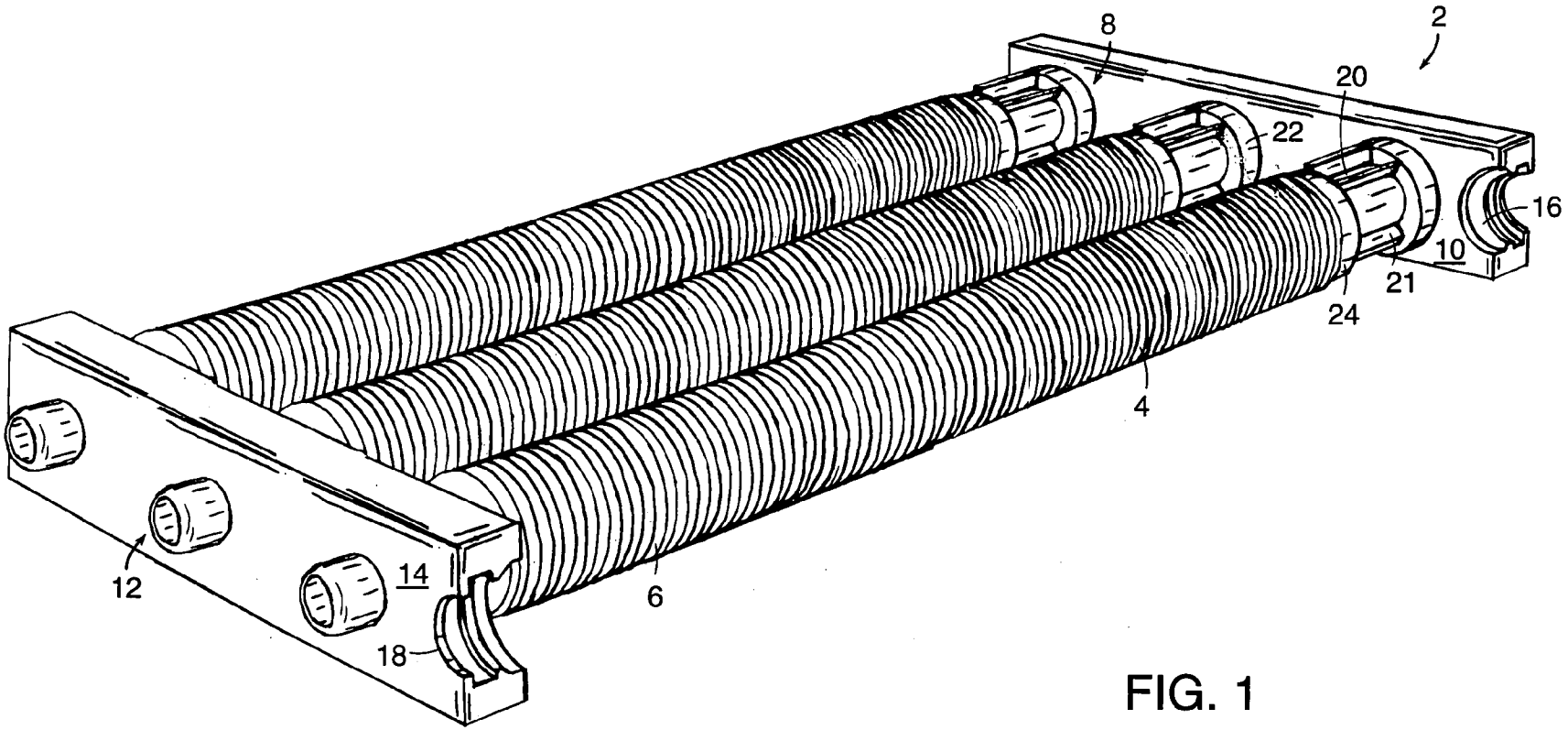
FIG. 1 is a schematic perspective view, shown partially broken away, of tube and fin assemblies of a heat exchanger of the present invention mounted in opposed header plates.

The figures referred to above are not drawn necessarily to scale and should be understood to present a representation of the invention, illustrative of the principles involved. Some features of the heat exchanger header plate depicted in the drawings have been enlarged or distorted relative to others to facilitate explanation and understanding. The same reference numbers are used in the drawings for similar or identical components and features shown in various alternative embodiments. Heat exchanger header plates as disclosed herein, will have configurations and components determined, in part, by the intended application and environment in which they are used.

DETAILED DESCRIPTION OF CERTAIN PREFERRED EMBODIMENTS

Referring to FIG. 1, a heat exchanger according to the present invention is shown partially cut away as it would be used to cool hot oil generated in the use of industrial machinery, e.g., a hydraulic transmission (not shown), and is referred to generally by the reference numeral 2. In a typical application, hot oil would flow through the inside of the flow tubes, while a cooling fluid such as air or other suitable cooling fluid would contact the outside fin section of the flow tube. It is to be understood, however, that the heat exchanger is not limited to use in cooling hot oil in industrial machinery, and may easily be used with other fluids or gases in other fields. For example, embodiments of the present invention find application in heat exchangers such as radiators used to cool an engine where coolant, such as water or antifreeze, flows through the flow tubes and fluid such as air or a suitable liquid can be used to flow around the exterior of the flow tubes. For convenience, the terms "upper" and "lower" are used herein to differentiate between the upper and lower ends of the heat exchanger and particular elements. It is to be appreciated that "upper" and "lower" are used only for ease of description and understanding and that they are not intended to limit the possible spacial orientations of the heat exchanger or its components during assembly or use.

Heat exchanger 2 comprises a plurality of flow tubes 4 having a plurality of fin elements or fins 6 secured to an exterior surface thereof. Tubes 4 are mounted at a first or upper end 8 to a first or upper header plate 10 and at a second or lower end 12 to a second or lower header plate 14. Upper and lower header plates 10, 14 are fixed with respect to one another by a frame of heat exchanger 2 (not shown). Examples of tube and fin element designs useful in the present invention are shown in U.S. Pat. Nos. 4,570,704; 4,344,478; 4,216,824; 3,391,732; 5,433,268; and 5,236,045 each of which are hereby incorporated by reference in its entirety for all purposes.

Heat exchangers within the scope of the present invention include those having a plurality of heat exchanger tubes arranged in columns and rows, and interconnected to receive and pass a heating/cooling fluid (dependent upon application).

The rows extend longitudinally across the heat exchanger, substantially perpendicular to the direction of air or other external fluid flow, and the columns are substantially perpendicular to the rows. The columns, for example, may be "in-line" or "off set" as shown below (top view of tube-and-fin assemblies):

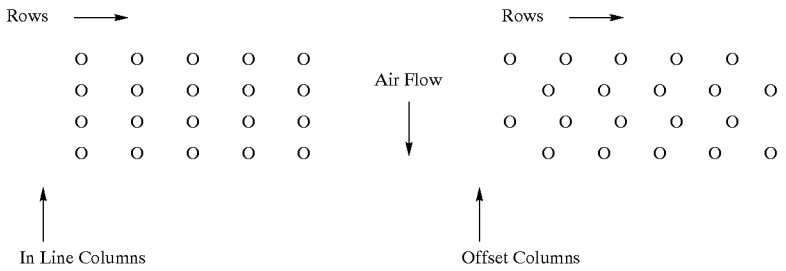

It is to be understood that alternate off set designs are within the scope of the present invention such as where tube-and-fin assemblies of every fourth row are aligned.

Figure 2:
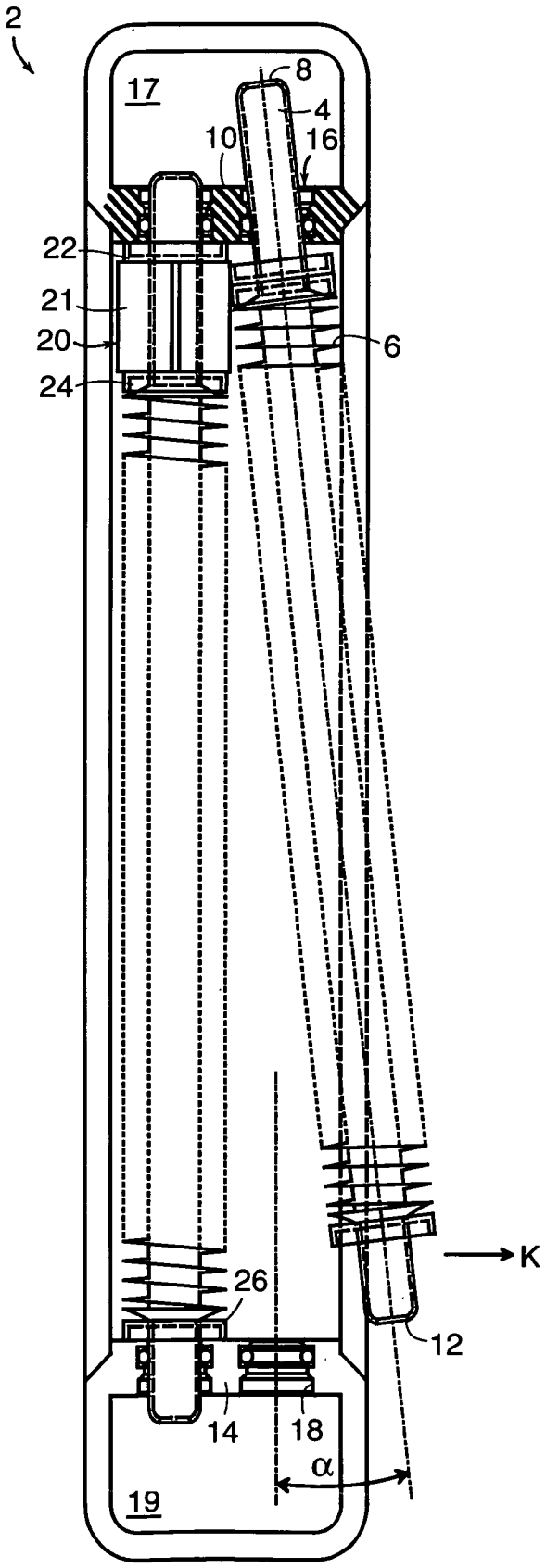
FIG. 2 is a schematic elevation view, shown partially in section, of a tube and fin assembly being removed from the heat exchanger of FIG. 1.

In a preferred embodiment, several rows of tubes 4 extend between upper and lower header plates 10, 14 forming columns. An upper end 8 of each tube 4 extends into an aperture 16 in upper header plate 10 and a lower end 12 extends into aperture 18 in lower header plate 14. Liquid flows from a first or upper tank 17 (seen in FIG. 2) above upper header plate 10 through tubes 4 into second or lower tank 19 (seen in FIG. 2) below lower header plate 14 where it then flows back to the machinery which generates the heated oil.

As shown in FIG. 1 and according to one embodiment of the present invention, a tube retainer 20 is mounted on first end 8 of each tube 4 proximate upper header plate 10. It is to be understood that tube retainer 20 is not be required for all applications of the present invention, especially those applications where a tube retainer is not necessary or desired, and accordingly certain embodiments of the present invention do not include a tube retainer. To the extent a tube retainer is desired, one embodiment of a tube retainer is as shown in 20 as a substantially C-shaped arcuate body and a plurality of planar, rectangular protruding portions 21 extending radially from the periphery of the arcuate body. Tube retainer 20 serves to hold tube 4 firmly in place within upper header plate 10 and also serves to deflect air toward fins 6. Further description of this one embodiment of a tube retainer 20 is found in U.S. Pat. No. 4,344,478, the contents of which are incorporated herein by reference. It is to be understood that alternate embodiments of the tube retainer useful in the present invention will become apparent to those skilled in the art based upon the disclosure herein. Examples of tube stays or alignment mechanisms if desired in the practice of the present invention are disclosed in U.S. Pat. No. 4,216,824, U.S. Pat. No. 4,570,704 and copending application Ser. No. 60/117,817 hereby incorporated by reference in its entirety.

As seen in FIG. 1, a first cap washer 22 is positioned between and abuts upper header plate 10 and tube retainer 20. A second cap washer 24 is positioned between and abuts tube retainer 20 and uppermost fin 6 or a shoulder on tube 4 (not shown). A third cap washer 26 is positioned between and abuts lower header plate 14 and a lowermost fin 6 or shoulder on tube 4 (not shown). As with the tube retainer described above, it is to be understood that the cap washers shown in FIG. 1 are not required for all applications of the present invention, especially those applications where a cap washer is not necessary or desired, and accordingly certain embodiments of the present invention do not include cap washers. In addition, the use of cap washers is by way of example only, and other configurations of washers or components performing the function of washers will become apparent to those of ordinary skill in the art based upon the present disclosure.

Some heat exchangers are designed so as to allow tubes 4 to be removable without the need for disassembling the frame of heat exchanger 2. This can allow quick replacement of damaged or worn tubes while minimizing the associated costs. To remove a tube 4 from heat exchanger 2, as seen in the embodiment illustrated in FIG. 2, tube retainer 20 is removed from tube 4. Upper end 8 of tube 4 is then pushed upwardly through aperture 16 of upper header plate 10 until lower end 12 is above lower header plate 14. Lower end 12 is then swung outwardly at an angle of a in the direction of arrow K or other suitable direction until it is free of lower header plate 14 and heat exchanger 2. Tube 4 is then removed from heat exchanger 2 by pulling downwardly on tube 4 until upper end 8 is free of upper plate 10. A new tube 4 can then be inserted by reversing the steps outlined above.

The upper and lower ends 8, 12 of tube 4 are exposed to system fluid at operating pressure in upper and lower tanks 17, 19, formed in part by the upper and lower header plates respectively, and, therefore, the high pressure side of the heat exchanger is that area above upper header plate 10 and below lower header plate 14. Correspondingly, the portion of tube and fin assembly 2 between the header plates which is exposed to air is considered the low pressure side. As used herein, the term "tube side" refers to the low pressure side of upper and lower header plates 10, 14 respectively, that is, the area of the upper and lower header plates typically exposed to the air and not exposed directly to the high pressure fluid in the upper and lower tanks 17, 19. Accordingly, the term "tank side" refers to the high pressure side of upper and lower header plates 10, 14, that is the area of the upper and lower header plates 10 and 14 exposed to the high pressure fluid in the upper and lower tanks 17, 19.

Figure 3:
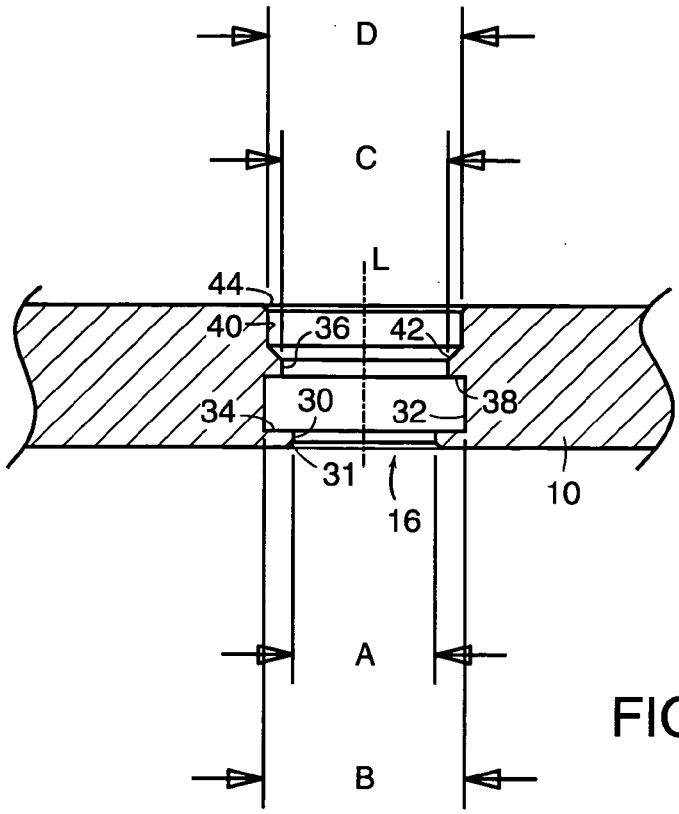
FIG. 3 is a schematic section view of an aperture in the header plate of FIG. 1.

The construction of aperture 16 is shown in more detail in FIG. 3. Aperture has longitudinal axis L. The diameter of aperture 16 is nonuniform along longitudinal axis L, that is, it is nonuniform throughout upper header plate 10. Instead, as shown in FIG. 3, the aperture 16 has at least two different portions and preferably, has four different portions along its length, each having a diameter which may be the same or different from an adjacent portion. The tube side, or first portion 30 has a first diameter A. In certain embodiments such as that shown in FIG. 3, the tube side edge 31 of first portion 30 is beveled or, alternatively, rounded at an angle. It is to be understood that the beveling of certain portions of the aperture wall, such as those portions shown in FIG. 3, is not be required for all applications of the present invention, especially those applications where beveling is not necessary or desired, and accordingly certain embodiments of the present invention do not include the beveling at the one or more location shown in FIG. 3. According to those certain embodiments, the locations where beveling is indicated in FIG. 3 would instead be squared edges. The next portion adjacent first portion 30 is second portion 32, and has a second diameter B which is larger than diameter A. A shoulder 34 is formed between first and second portions 30, 32. Third portion 36 is adjacent second portion 32 and has a diameter C which is smaller than diameter B and typically larger than diameter A. A shoulder 38 is formed between second and third portions 32,36. The fourth portion 40 which is immediately tank side is adjacent third portion 36 and has a diameter D which is larger than diameter C. As shown in FIG. 3, edge 42 of fourth portion 40 is beveled or, alternatively, rounded as is edge 44 of fourth portion 40.

Figure 4:
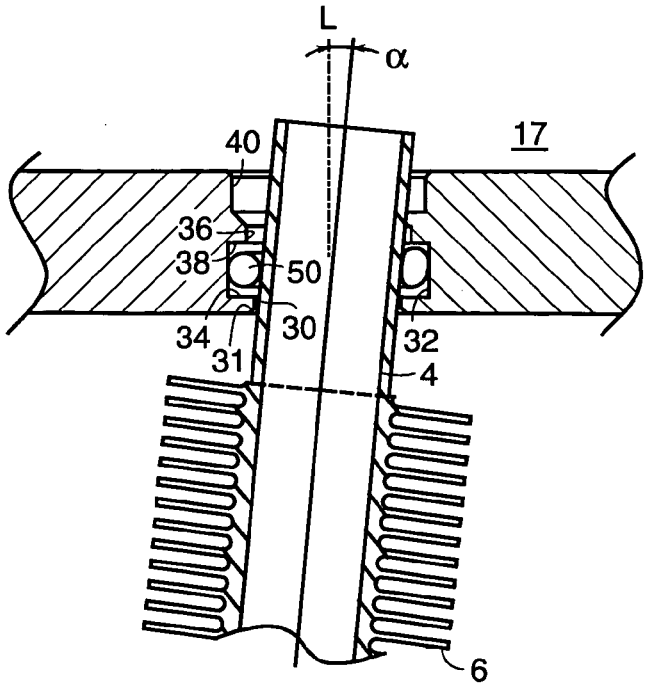
FIG. 4 is a schematic section view of a tube and fin assembly being removed the header plate of FIG. 1.
Figure 6:
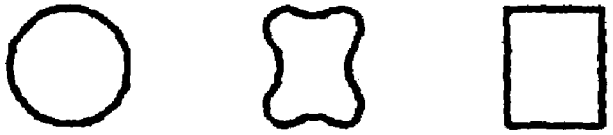
FIG. 6 is a cross-sectional view of alternate seal designs useful in the present invention.
Figure 6:
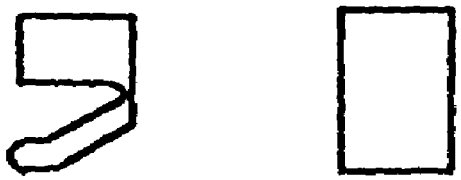

Turning now to FIG. 4, the interaction of tube 4 with aperture 16 during removal and installation of tube 4 can be seen more clearly. A seal 50 surrounds tube 4 and is contained within second portion 32. Seals according to the present invention include those having differing sizes and shapes. For example, seals having a circular cross-section are useful within the scope of the present invention, such as those seals commonly known as "O-rings." Other useful seals include those having a square or rectangular cross-section or a cross-section resembling that of an "X," as shown in FIG. 6. Other suitable seal shapes will become apparent to those skilled in the art based upon the disclosure presented herein and the configuration of the particular aperture, flow tube and chamber within which the seal is seated. The seals may be fashioned from any suitable elastomeric material capable of withstanding operating pressures and temperatures of a given heat exchanger. Useful seals are also resistant to degradation by fluids used in a given heat exchangers. The seals according to the present invention may be installed into the aperture by hand or by suitable instrument so as to seat the seal into a given location in the aperture. In use, seal 50 is compressed a predetermined amount to provide a proper seal between the tube 4 and the header plate aperture. Seal 50 is held in place by shoulders 34 and 38, with shoulder 34 providing support for seal 50 to resist the pressure incurred at the high pressure side of upper header plate 10, and shoulder 38 providing support for seal 50 during the angled installation of tube 4. Aperture 16 is preferably designed to hold seal 50 captive within upper header plate 10 during installation and removal of tube 4. That is, seal 50 is contained entirely within aperture 16 and does not extend above the tank side of the header plate 10 into the upper tank 17 or below the tube side of the header plate 10. Aperture 16 must be able to accommodate tube 4 being positioned at angle $\alpha$ with respect to longitudinal axis L, which is necessary in order for lower end 12 to clear lower header plate 14 or heat exchange frame during installation and removal without dismantling the frame of the heat exchanger.

The actual dimensions of diameters A, B, C, and D, as well as the depth of each portion, that is, its dimensional length along longitudinal axis L, will be determined by the specific application of a given heat exchanger and the desired insertion angle $\alpha$ required for insertion or removal of a heat exchanger tube. Certain factors that will affect the desired insertion angle $\alpha$ include such factors as the diameter of the flow tube, the length of the flow tube, the dimensions of the fin elements of the flow tube, the operating pressure of the heat exchanger, the type of seal used, and beveling of the portions of the aperture, if desired. Diameter A must be large enough to allow tube 4 to be inserted at insertion angle $\alpha$ to axis L without binding the tube within the portion 30 of the header plate and preventing its proper insertion into the header plate, but small enough to provide proper support to retain the seal under system operating pressure. At the limiting tube angle $\alpha$ for a given heat exchanger as shown in FIG. 4, the left side of tube 4, contacts, and its range of motion is limited by, the tube side edge 31 of first portion 30. The right side of tube 4, as seen in FIG. 4, contacts, and it range of motion is limited by, tank side edge of first portion 30 at shoulder 34.

Diameter B must be larger than diameter A in order to provide for seal 50 and shoulder 34 between first and second portions 30, 32. Diameter B and corresponding shoulders fixedly retain seal 50 and is sized to allow seal 50 to be compressed to a designed compression level when tube 4 is in its normal approximately vertical orientation, seen as the left most tube 4 in FIG. 2.

Diameter C must be smaller than diameter B in order to provide for shoulder 38 between second and third portions 32, 36. Diameter C is sized to provide clearance for tube 4 when it is oriented at angle $\alpha$, as well as providing proper support for Seal 50 during tube installation and removal as well as low pressure operation. Low pressure operation refers to a condition in which the pressure sides of upper header plate 10 are reversed. That is, the pressure within upper tank 17 is lower than that portion of the heat exchanger between upper and lower header plates 10, 14 which is typically exposed to air. In such a reverse pressure condition, shoulder 38 would provide support against the source of higher pressure. Diameter C may be, in certain preferred embodiments, approximately equal to diameter A.

In certain nonlimiting embodiments, diameter D is larger than diameter C. Diameter D is sized to provide clearance for tube 4 when tube 4 is at insertion angle $\alpha$ with respect to longitudinal axis L to prevent binding of tube 4. In other embodiments, diameter D is approximately equal to diameter C or the fourth portion 40 may gradually increase in a beveled manner toward the tank side surface of the heat exchanger plate.

The depths of each portion may vary as well based on operating conditions of the heat exchanger. Specifically, for example, the depth of first portion 30 and third portion 36 must be sized to provide a sufficient thickness for shoulder 34 and shoulder 38 which can withstand the pressures incurred by Seal 50.

In the illustrated embodiments, aperture 18 has the same construction as aperture 16. It is to be appreciated that in other embodiments, aperture 18 may have a constant diameter, or, alternatively, have a single channel containing a groove incorporating a seal to provide a seal between tube 4 and aperture 18.

Figure 5:
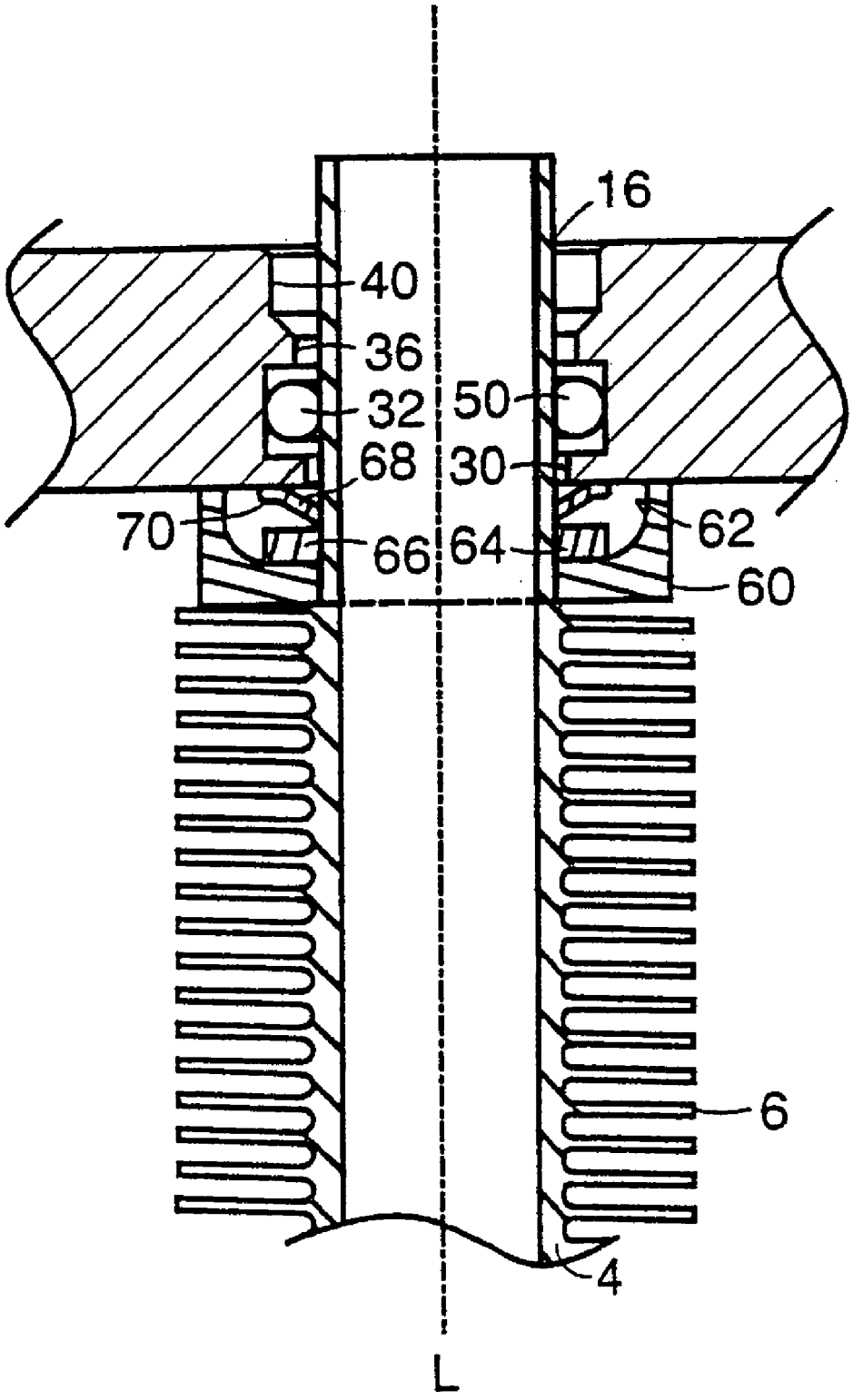
FIG. 5 is a schematic section view of an alternative embodiment of a tube and fin assembly of FIG. 1, shown mounted in a header plate with a dust seal and cupped washer.

In another preferred embodiment, shown in FIG. 5, a cupped washer 60 is provided on tube 4 between upper header plate 10 and an uppermost fin 6. Cupped washer 60 has a substantially C-shaped cross-section forming a concave surface 62 which faces upper header plate 10. A contamination seal 64 is positioned between upper header plate 10 and concave surface 62. Contamination seal 64 is formed of a first portion 66 having a substantially rectangular cross-section and a second portion 68. Second portion 68 extends upwardly and radially outwardly from an upper and radially inner edge of first portion 66, terminating in a lip 70 which extends radially outwardly. In other preferred embodiments, contamination seal 64 may have other constructions, e.g., a substantially rectangular cross section.

Contamination seal 64 acts to protect seal 50 from dust and other contaminants which may be encountered in some applications. Cupped washer 60 protects contamination seal 64 and/or apertures 16, 18 from large objects, high-pressure water washers, and other items which may damage contamination seal 64 and/or apertures 16, 18 or otherwise impair the functionality of heat exchanger 2. It is to be appreciated that contamination seal 64 may, in certain preferred embodiments, be used without cupped washer 60. A similar cupped washer 60 and contamination seal 64 may be placed on lower end 12 of tube 14 adjacent lower header plate 14.

In light of the foregoing disclosure of the invention and description of the preferred embodiments, those skilled in this area of technology will readily understand that various modifications and adaptations can be made without departing from the true scope and spirit of the invention. All such modifications and adaptations are intended to be covered by the following claims.

What is claimed is:

1. A header plate for a heat exchanger comprising:

a plate having a tube side and a tank side; and a plurality of apertures extending through the plate;

each aperture having a longitudinal axis L and a wall of nonuniform diameter at four locations, the diameter at each location being sufficiently large enough to accommodate insertion of a flow tube into the aperture at an insertion angle $\alpha$ to the longitudinal axis L to allow insertion and removal of a flow tube from the heat exchanger without disassembling a frame of the heat exchanger, where $\alpha$ is greater than zero degrees, and including a seal fixedly engaged within the aperture by shoulders formed by differing diameters of the wall;

wherein each aperture has a first portion to accept a flow tube, the first portion adjacent the tube side and having a first diameter to accommodate insertion of the flow tube into the first portion and into the aperture at the insertion angle $\alpha$;

a second portion adjacent the first portion and having a second diameter larger than the first diameter of the first portion, wherein the seal is fixedly engaged in the second portion, with the second portion having shoulders for retaining the seal during insertion and removal of the flow tube;

a third portion adjacent the second portion with the third portion having a third diameter smaller than the second diameter of the second portion, and the third diameter is larger than the first diameter of the first portion; and;

a fourth portion adjacent the third portion, the fourth portion having a diameter larger than the third diameter of the third portion.

2. The header plate of claim 1, wherein the third portion extends to the tank side of the plate.

3. The header plate of claim 1, wherein the first portion has a beveled or rounded edge at the tube side of the plate.

4. The header plate of claim 1, wherein the fourth portion has a beveled or rounded edge at the tank side of the plate.

5. A heat exchanger comprising:

a plurality of flow tubes having a first end and a second end and a plurality of fins secured to an exterior surface thereof;

a first header plate having a substantially planar tank side and a substantially planar tube side and having a plurality of apertures, each aperture having a longitudinal axis L and a wall of non-uniform diameter at at least three locations, each of the three locations having a diameter different than the diameter at each of the other two locations, and including a seal fixedly engaged within the aperture between the substantially planar tank and tube sides by shoulders formed by differing diameters of the wall; and a second header plate having a plurality of apertures sized to receive a second end of a flow tube, and each flow tube engaging corresponding apertures of the first and second header plates;

wherein the diameter at each location is sufficiently large enough to accommodate insertion of a flow tube into the aperture from the tube side at an insertion angle $\alpha$ to the longitudinal axis L and removal of the flow tube from the tube side without disassembling a frame of the heat exchanger, where a is greater than zero degrees, and wherein the seal is configured to engage the flow tube after insertion of the flow tube into the aperture.

6. The heat exchanger of claim 5, wherein each aperture of the first header plate includes a first portion adjacent the tube side to accept the flow tube, the first portion having a first diameter to accommodate insertion of the flow tube into the first portion and into the aperture at the insertion angle $\alpha$.

7. The heat exchanger of claim 6, wherein the seal is fixedly engaged in a second portion of the aperture of the first header plate, the second portion adjacent the first portion and having a second diameter larger than the first diameter of the first portion with the second portion having shoulders for retaining the seal during insertion and removal of the flow tube.

8. The heat exchanger of claim 7, wherein the aperture of the first header plate includes a third portion adjacent the second portion wherein the third portion having a third diameter smaller than the second diameter of the second portion and wherein the third diameter is larger than the first diameter of the first portion.

9. The heat exchanger of claim 8, wherein the third portion extends to the tank side of the header plate.

10. The heat exchanger of claim 8, wherein the aperture of the first header plate includes a fourth portion adjacent the third portion, the fourth portion having a diameter larger than the third diameter of the third portion.

11. The heat exchanger of claim 10, wherein the fourth portion has a beveled edge at the tank side of the header plate.

12. The heat exchanger of claim 6, wherein the first portion has a beveled edge at the tube side of the header plate.

13. The heat exchanger of claim 5, further comprising a plurality of contamination seals, each contamination seal engaging a corresponding flow tube and contacting the tube side of a corresponding header plate, and one of the first and second header plates.

14. The heat exchanger of claim 13, wherein the contamination seal further includes a washer.

* * * * *